US006634642B1

(12) United States Patent
Leon

(10) Patent No.: US 6,634,642 B1
(45) Date of Patent: Oct. 21, 2003

(54) IMMIGRATION AND MONEY BOARD GAME

(75) Inventor: Teresa de Jesus Leon, Miami, FL (US)

(73) Assignee: Teivy Development Corp., Miami, FL (US)

( * ) Notice: Subject to any disclaimer, the term of this patent is extended or adjusted under 35 U.S.C. 154(b) by 0 days.

(21) Appl. No.: 10/045,834

(22) Filed: Jan. 11, 2002

(51) Int. Cl.[7] ..... A63F 3/00
(52) U.S. Cl. ..... 273/257; 273/243; 273/279
(58) Field of Search ..... 273/243, 248, 273/256, 257, 279, 278

(56) References Cited

U.S. PATENT DOCUMENTS

| | | | | |
|---|---|---|---|---|
| 4,315,627 A | * | 2/1982 | Schlegel et al. | 273/249 |
| 4,625,970 A | * | 12/1986 | Childs et al. | 273/257 |
| 4,932,667 A | * | 6/1990 | Gorski et al. | 273/249 |
| 6,106,300 A | | 8/2000 | Kiyosaki et al. | 434/107 |

* cited by examiner

*Primary Examiner*—Benjamin H. Layno
*Assistant Examiner*—Vishu Mendiratta
(74) *Attorney, Agent, or Firm*—J. Sanchelima; A. Bordas

(57) ABSTRACT

An immigration board game and method for playing it where the players live through the difficulties typically associated with immigrants as they adjust to the American way of life and seek the American dream. The game is played on a board with a predetermined number of contiguously disposed spaces over which each player's token advances. Initially, each player is assigned a unique legal status through aleatory means. Each space is associated with instructions providing for penalties and awards. Additionally, some of these spaces direct the players to one or more sets of cards with additional awards and non-pecuniary penalties directed to affect the legal status of the player. Choices are given throughout the game for the players to choose sets with or without pecuniary rewards depending on whether the player wants to take his/her chances with immediate economic rewards or improvements in his/her legal status.

3 Claims, 4 Drawing Sheets

IMMIGRATION AND MONEY BOARD GAME

II. BACKGROUND OF THE INVENTION

1. Field of the Invention

The present invention relates to a board game, and more particularly, to such a game involving matters relating to the legal and economic status of immigrants in the United States over time.

2. Description of the Related Art

Many designs for board games have been developed in the past. None of them, however, relates to a game where the players take the place of immigrants' difficulties and achievements in their search for the American dream by making choices, taking advantage of opportunities, learning lessons from experiences, and suffering the consequences of his/her actions Applicant believes that the closest reference corresponds to U.S. Pat. No. 6,106,300 issued to Kiyosaki et al. on Aug. 22, 2000 for a game for teaching fundamental aspects of personal finance, investing and accounting to children. As in the present invention, the patented game involves the use of money and financial concepts. However, it differs from the present invention because the Kiyosaki's patented game does not relate to the alternatives and/or options for immigrants as they develop themselves in the United States. The present invention also distinguishes itself from the prior art in that the players are initially categorized in one of several classes of immigrants (tourists, exile, etc.) with different legal status that will have an impact on his/her opportunities and consequences throughout the game. To overcome these initial handicaps or advantages, a player may decide to take more or less risks in his/her decisions. Some decisions (like drawing a card from a stack "Money", instead of stack "Immigrant") are more likely to involve a financial advantage. Alternate choices may provide educational, social or legal advantages that may have an indirect economic impact.

Other patents describing the closest subject matter provide for a number of more or less complicated features that fail to solve the problem in an efficient and economical way. None of these patents suggest the novel features of the present invention.

III. SUMMARY OF THE INVENTION

It is one of the main objects of the present invention to provide an instructive game for players to learn about the risks, choices and options that an immigrant has to affront when he/she immigrates to the United States.

It is another object of this invention to provide an entertaining game for children and adults while teaching them about immigration and money issues.

It is still another object of the present invention to provide a game where the individual players' rules may differ from each other depending on an initial aleatory event that classifies each player under one of several immigrant classes each with a unique initial legal status. These different classes carry different handicaps or advantages.

Further objects of the invention will be brought out in the following part of the specification, wherein detailed description is for the purpose of fully disclosing the invention without placing limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which.

V. DETAILED DESCRIPTION OF THE PREFERRED EMBODIMENT

Figure 1:
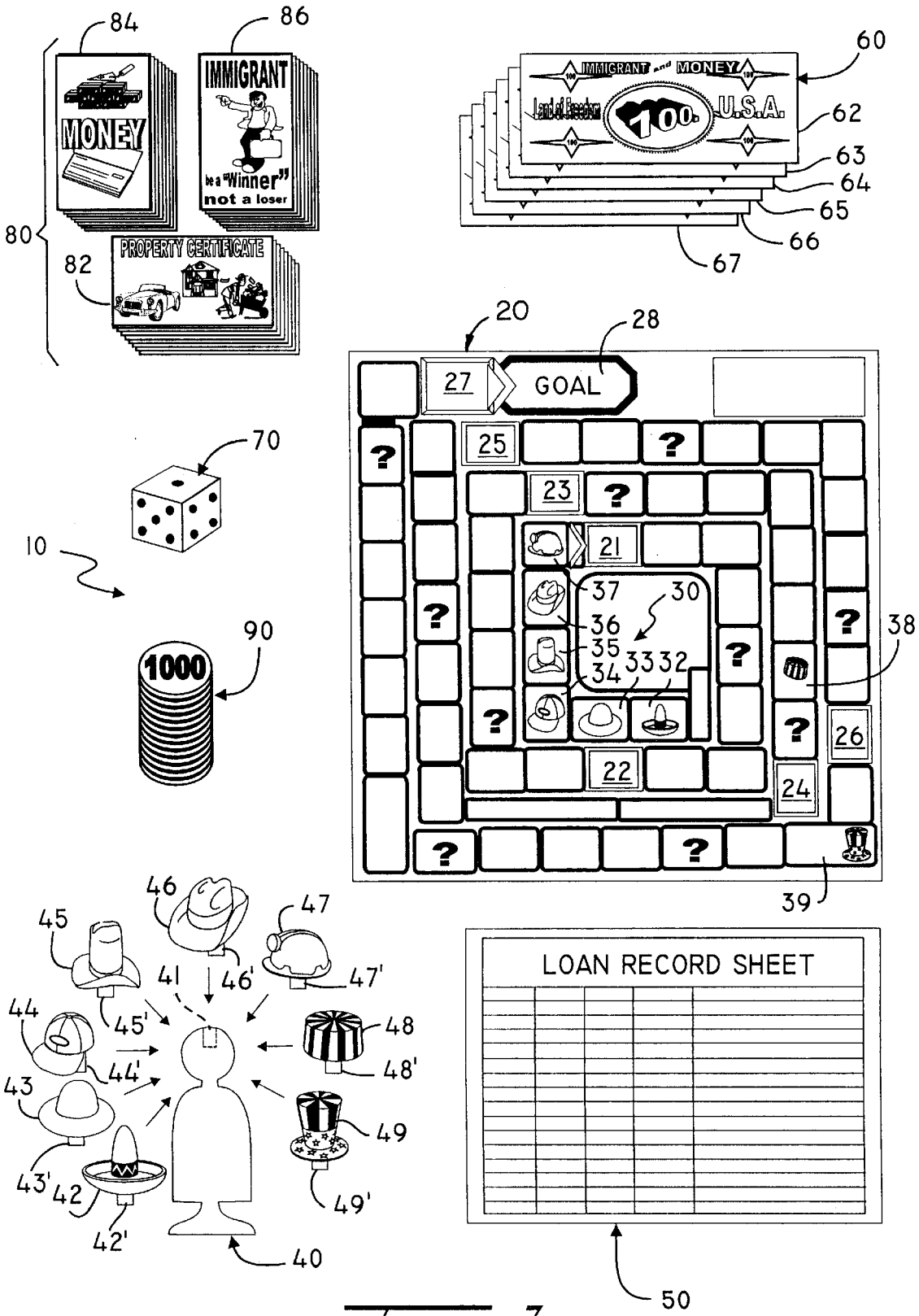
FIG. 1 represents a schematic illustration of one of the preferred embodiments for the present invention showing the components of the board game.

Referring now to the drawings, where the present invention is generally referred to with numeral 10, it can be observed that it basically includes game board 20, player pieces or tokens 40, loan record sheet 50, game money 60, dice 70, cards 80 and point tokens 90.

As shown in FIG. 1, game board 20 has spaces for different purposes and aligned in a spiral like arrangement. To start the game, the players throw a dice 70, or equivalent aleatory device, to obtain a number. The player with the highest number goes first. Then, the player to his/her left is next.

Figure 2:
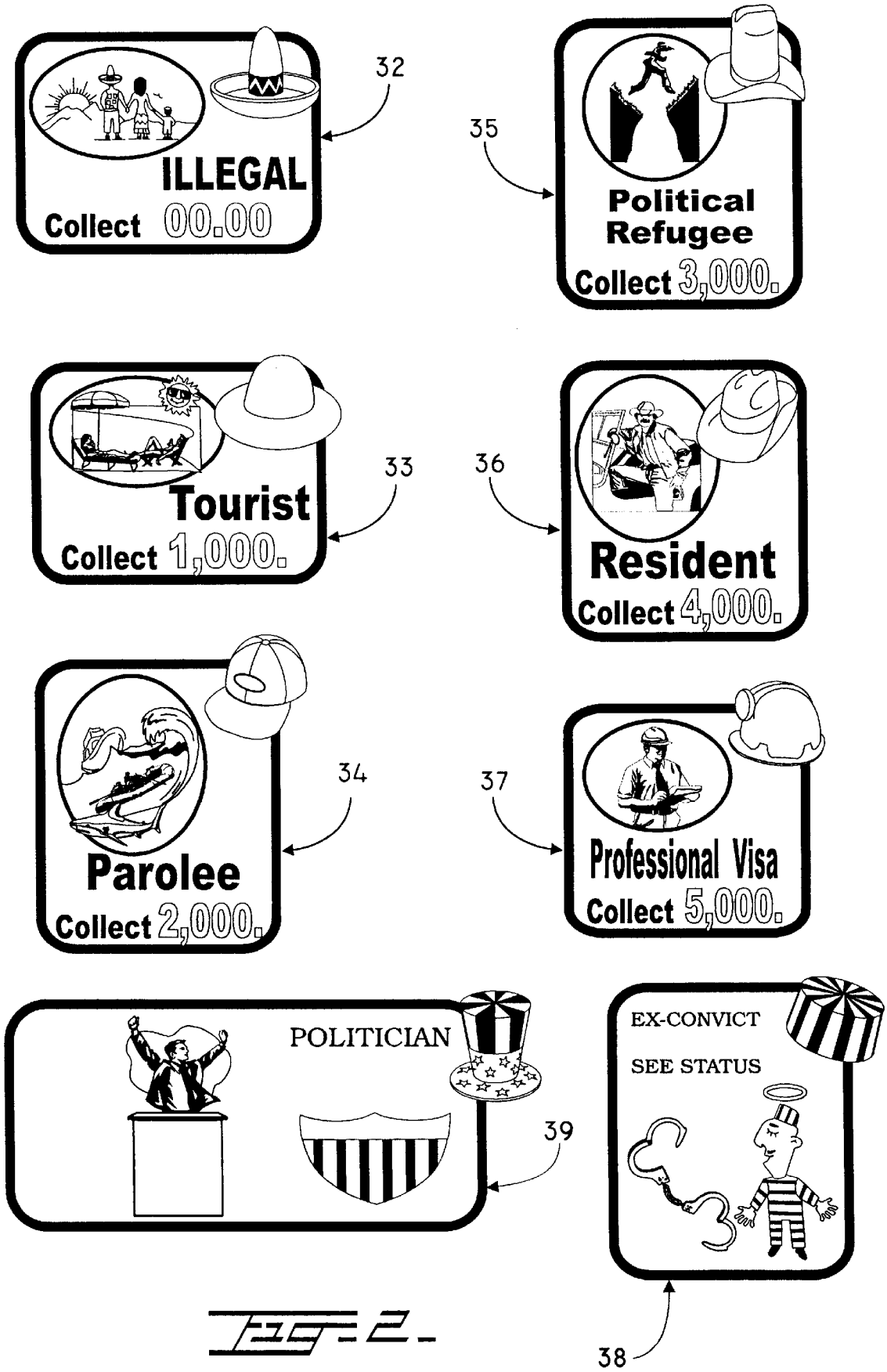
FIG. 2 shows a schematic illustration of the spaces defining the legal status of the players during the first stage of the game.
Figure 3:
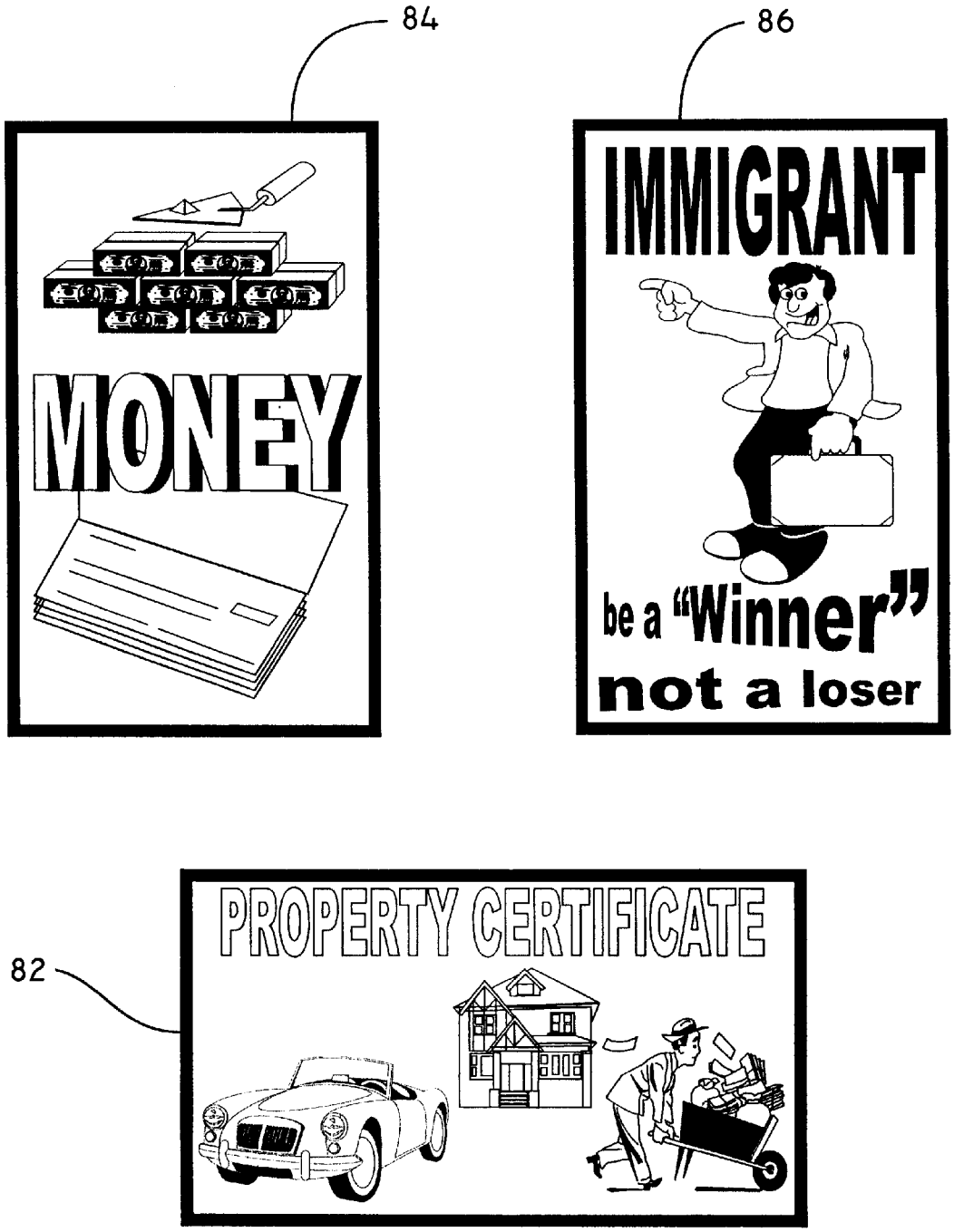
FIG. 3 illustrates a schematic illustration of the cards used in the game each showing one of the possible messages.

Game board 20 is divided in seven stages separated by opportunity spaces 21; 22; 23; 24; 25; 26; 27. Goal space 28 is located at the end. The first stage, before opportunity space 21, determines the initial legal status of the player when he/she enters the United States. There are six spaces 30, one for each possible number on dice 70. Depending on the number obtained, the player will be assigned one of the following legal classes or status:

32—illegal
33—tourist
34—parolee
35—political refugee
36—resident
37—professional visa Spaces group 30 for the first stage are represented in FIG. 2. The status assigned by initially landing in spaces 32; 33; 34; 35; 36 or 37 impacts the subsequent development of the player's game during the next two stages. Each status receives a predetermined treatment for collecting and receiving payments. The illegal status assigned to space 32 causes the player to pay double any fee amount assessed and to collect only 50% of the amount awarded. Tourist status assigned by space 33 prevents a player from collecting any awards and forces him/her to pay double for any penalties. This is intended to reflect the problems encountered by those who enter the United States illegally, or overstay the time period stated in their visas. Status parolee assigned to space 34, collect 100% of the amounts awarded and do not have to pay anything when assessed a penalty amount. Political refugee status is obtained by landing in space 35 and the players collect 100% of the awarded amounts and pay double for the penalties assessed. Resident status is obtained by landing in space 36 and the player collects 100% of any amount awarded and pay 100% of any assessments or penalties. Those who land in professional visa status space 37 collect double the amount and pay double also. After the initial landings, the legal classification obtained stays with the player until his/her legal status changes later on in the game.

Player's tokens 40 have an anthropomorphic shape with openings 41 on the top ends. Hats 42; 43; 44; 45; 46; 47; 48 and 49 have pin 42'; 43'; 44'; 45'; 46'; 47'; 48' and 49' respectively. Once a legal status (32; 33; 34; 35; 36 or 37) is defined, each player selects a hat from 42; 43; 44; 45; 46 or 47 and inserts pin 42'; 43'; 44'; 45'; 46'; or 47' in openings 41 on top ends of her/his game tokens 40.

Player game tokens 40 are then positioned before opportunity space 21 and the first player starts by throwing dice 70. The player advances the spaces that the number shown in dice 70 indicates. Each time a player lands on a space, he/she must read the instructions written on the space, and comply with these instructions according to his/her legal status.

Figure 4:
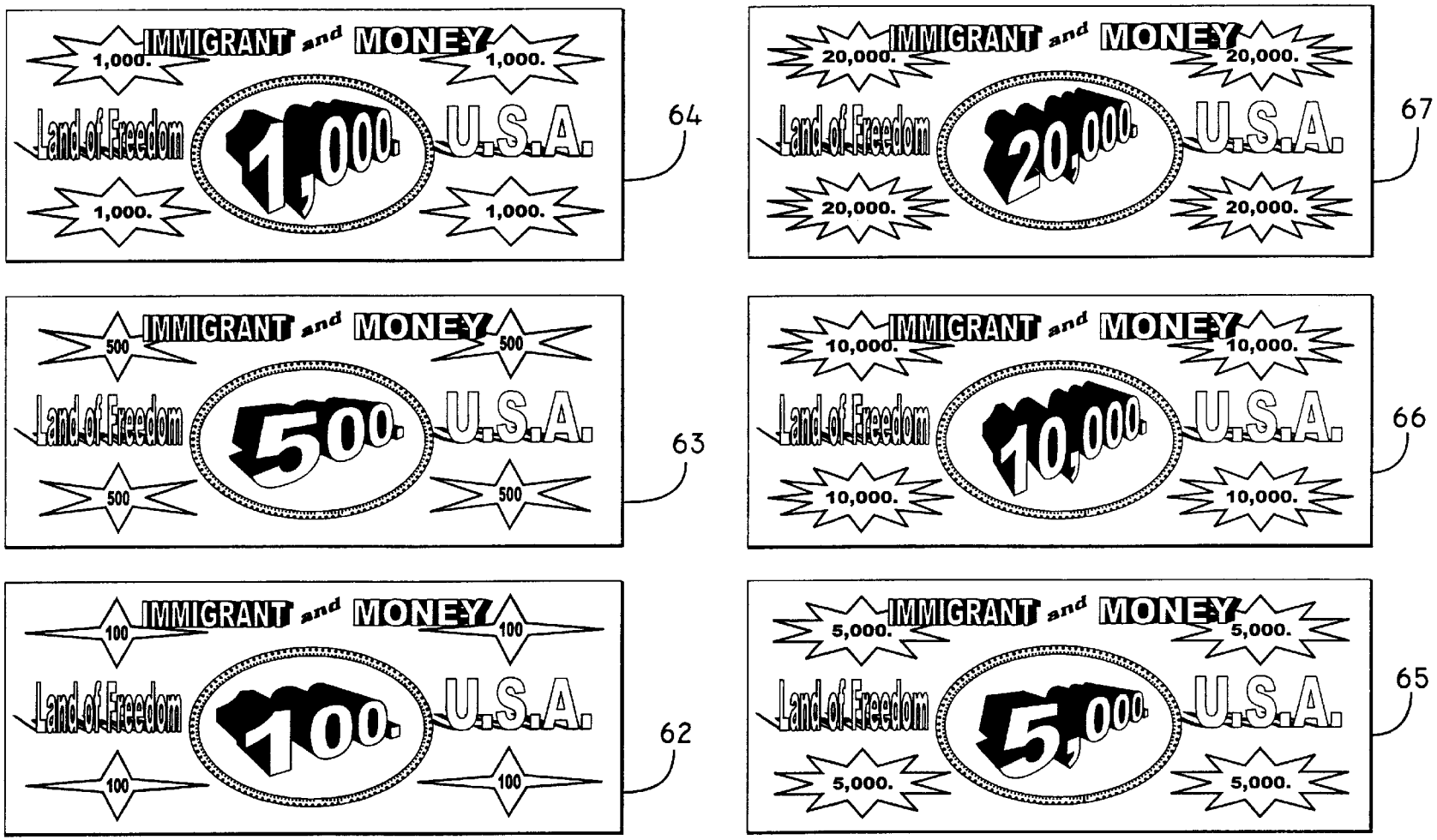
FIG. 4 is a schematic illustration of the simulated money used in the game.

The second stage or group of spaces starts after opportunity space 21 and ends before opportunity space 22. The instructions shown here are typical of an immigrant beginning his/her life in the United States. Typically he/she is not proficient in the English language. This stage is characterized by presenting many economic difficulties Money bills 60 are used to implement transactions in the game. Money bills 60, as best represented in FIG. 4, are issued in the following denominations:

$100 bills 62

$500 bills 63

$1,000 bills 64

$5,000 bills 65

$10,000 bills 66

$20,000 bills 67

Point tokens 90 are used to accumulate civic points during the game that are needed to obtain the legal resident status first and subsequently citizenship status. Point tokens 90, as seen in FIG. 1, are issued in tokens of 1000 points each. During the game, the players must balance their need of improve their legal status and/or take advantage of the money opportunities to be successful. Citizens have more opportunities than residents. Residents have more opportunities than non-resident immigrants.

Each space commands the player to take either a money card 84 or an immigrant card 86 from two stacks of opportunity cards 80. Immigrant cards 86 are slanted towards providing more non-pecuniary benefits that are more relevant to the immigrant (passing an English course, etc.). If the space is marked with a question mark "?", the player takes both card types, one money card 84 and one immigrant card 86 from the group of cards 80. Money cards 84 have different messages regarding monetary awards and penalties for typical activities in daily life such as paying taxes, insurance bills, rent, traffic tickets, etc. or receiving money for different reasons. Some of these activities are contests, payroll awards, insurance compensation, bank account interest, etc. Immigrant cards 86 have different messages pertaining to the legal status of the players allowing them to win (or lose) points to obtain a better status during the game.

There are also property cards 82 with different amounts. Property cards 82 are used when a player buys a property; he/she will receive a certificate in the amount corresponding to the value of the property acquired. These property cards 82 are valued at the end of the game.

If any player has to pay an amount for which he/she does not have the money, a loan in the requested amount is recorded in loan record sheet 50. The loan must be paid at the end of the game, including an additional predetermined amount as interest. Interest increases every time a player throws the dice. Any interest rate can be selected but 10% is the simplest to compute.

During the third stage, after space opportunity 22 and before space opportunity 23, the instructions shown are typical of an immigrant who has already been in the country for a few years and is faced with different opportunities. This stage is characterized by a better standard of living, higher income, and the possibility to apply for resident status if he/she has saved the required points and money.

During the fourth stage, after opportunity space 23 and before opportunity space 24, the instructions on the spaces allow the player to raise his/her status, if he/she has the required points and money. This stage is characterized by an above average living standard with better income and more expenses. Also, in this fourth stage, the players can get the status of ex-convict by landing in space 38 if he or she has a legal problem leading to a criminal conviction. If so, he/she must change his/her hat to the ex-convict hat 48. He/she will receive only the 50% of the awards and will pay 100% of the penalty amounts specified in the spaces or in the money cards 84 until the game is over.

During the fifth stage, after space 24 and before opportunity space 25, the instructions here allow a player to graduate from college, obtain a professional license, title, degree, or be promoted to a better position at work. Therefore, still higher incomes and expenses, associated with higher standards of living characterize this stage. The players also travel on vacations and buy houses and other properties in this stage.

During the sixth stage, after opportunity space 25 and before opportunity space 26, the instructions allow the player to open his/her own business, or to be promoted to a higher position at work. Therefore, in this stage the players will have higher incomes, higher expenses, and a luxurious way of life.

During the seventh stage, after space 26 and before space 27, the player has the possibility to apply for citizenship status in any of the spaces of this seventh stage, if he/she has saved the required points and money. Therefore, after pass opportunity space 26 the most of the players take off their hats, unless they are ex-convicts who will keep their hats. After a player gets his/her citizenship by meeting the required number of points and money, the remaining points can be changed by money in the amount of 1/1, that is a point token 90 would be changed to $1000.00. The minimum amount of money and points can be set to 5,000 points and $10,000.00, for instance. Also in this seventh stage, the instructions allow the players to be promoted to an executive position at work and participate in the political arena. In this stage the players will also participate in charities and other civic activities. If a player is selected as a politician by stopping in space 39, he must use politician's hat 49. As a politician he/she triplicates any awards and pays 100% of the penalties specified on the spaces or in the money cards 84.

Finally, the players need to obtain the exact number in dice 70 to land on goal/end space 28. If the number in dice 70 exceeds the spaces needed to land on goal/end space 70, then the player does not move in that turn. The player still takes one card 84 each time he/she is unable to move. Therefore, a player may receive or lose money depending of his/her current status while trying to make it to the end space. Once the first player reaches goal/end space 70, the game is over and each player counts the money and adds up the value of his/her properties.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A method of playing an immigration game, comprising the steps of:

A) determining through aleatory means the order in which the players are going to participate;

B) assigning through aleatory means a legal status for each player from a group of predetermined unique legal status relating to characterization of immigrants under immigration laws and each of said unique legal status including a unique treatment rules for collecting awards and paying pecuniary penalties;

C) assigning tokens to each player; and

D) advancing said tokens over a plurality of predefined spaces, said spaces being associated with first instructions providing for awards and penalties for players landing in said spaces, one of said spaces representing the start space and another space at the end representing the finish space and wherein a predetermined number of said spaces include instructions to draw a card from at least two sets of cards associated with second instructions providing for penalties and awards, and at least one of said sets includes non-pecuniary awards only and directed to affect the legal status of the player, said spaces are associated with ever increasing standards for rewards and penalties.

2. The method set forth in claim 1 wherein the legal immigration status of each player changes when a predetermined number of non-pecuniary awards are earned.

3. The method set forth in claim 2 further including the step of:

E) advancing loans to the players upon request and charging a predetermined interest based on the number of turns of the player.

* * * * *